US007503249B2

(12) United States Patent
Jackson et al.

(10) Patent No.: US 7,503,249 B2
(45) Date of Patent: Mar. 17, 2009

(54) BARRELS FOR ELECTROMAGNETIC GUNS

(75) Inventors: Thomas R. Jackson, San Diego, CA (US); Thomas W. Hurn, Poway, CA (US)

(73) Assignee: General Atomics, San Digeo, CA (US)

( * ) Notice: Subject to any disclaimer, the term of this patent is extended or adjusted under 35 U.S.C. 154(b) by 172 days.

(21) Appl. No.: 11/380,605

(22) Filed: Apr. 27, 2006

(65) Prior Publication Data

US 2006/0243124 A1 Nov. 2, 2006

Related U.S. Application Data

(60) Provisional application No. 60/675,740, filed on Apr. 27, 2005.

(51) Int. Cl.
*F41A 21/02* (2006.01)
*F41B 6/00* (2006.01)
*F41F 1/00* (2006.01)

(52) U.S. Cl. ..... 89/8; 89/16; 124/3

(58) Field of Classification Search ..... 89/8, 89/16; 124/3

See application file for complete search history.

(56) References Cited

U.S. PATENT DOCUMENTS 3,616,521 A 11/1971 Boggio
3,969,812 A 7/1976 Beck
4,343,223 A * 8/1982 Hawke et al. ..... 89/8
4,624,173 A 11/1986 Creedon
4,681,015 A * 7/1987 Creedon ..... 89/8
4,681,016 A * 7/1987 Creedon ..... 89/8
4,771,530 A 9/1988 Creedon
4,774,872 A * 10/1988 Creedon ..... 89/8
4,840,200 A 6/1989 Creedon
4,846,911 A 7/1989 Tackett et al.
5,065,795 A 11/1991 Creedon
5,076,135 A 12/1991 Hurn et al.
5,125,179 A 6/1992 Campbell et al.
5,233,903 A * 8/1993 Saphier et al. ..... 89/8
5,285,763 A 2/1994 Igenbergs
5,303,633 A * 4/1994 Guthrie et al. ..... 89/8
5,355,764 A * 10/1994 Marinos et al. ..... 89/8
5,454,289 A 10/1995 Bacon et al.

(Continued)

FOREIGN PATENT DOCUMENTS

GB 2187826 9/1987

*Primary Examiner*—Bret Hayes
(74) *Attorney, Agent, or Firm*—Fitch, Even, Tabin & Flannery

(57) ABSTRACT

A gun barrel for firing a projectile and particularly a rail gun barrel that comprises a pair of spaced apart rails and a pair of spaced apart insulators, which separate the rails, and together define a composite bore, all disposed centrally within an outer rigid tube. A prestressed filament-wound polymeric resin shell immediately surrounds and applies compressive stress to this composite, bore-defining structure. A pressure medium, positioned between the shell and the interior surface of the outer tube, is operative to apply compressive stress to the shell at least at locations generally radially outward of the rails. The compressive stresses applied by the combination of the prestressed shell and the pressure medium are additive and effectively preload the rails and the composite bore structure to resist overall forces encountered during projectile firing which, in a rail gun, include asymmetric loads upon the rails from electromagnetic repulsion forces and also axisymmetric bursting forces.

16 Claims, 3 Drawing Sheets

U.S. PATENT DOCUMENTS 6,076,562 A 6/2000 Kuo
6,190,481 B1 2/2001 Iida et al.
6,401,963 B1 6/2002 Seal et al.
6,725,759 B1 4/2004 Kathe et al.

* cited by examiner

BARRELS FOR ELECTROMAGNETIC GUNS

This application claims priority from U.S. Provisional Application Ser. No. 60/675,740 filed Apr. 27, 2005.

The present invention relates to improved tubular structures capable of withstanding high internal pressures, more particularly to gun barrels for firing projectiles, and still more particularly to barrels for electromagnetic rail guns and methods for making same.

BACKGROUND OF THE INVENTION

Various types of rail guns have been proposed for using electromagnetic forces to accelerate projectiles to high velocities and direct them toward a target. U.S. Pat. Nos. 1,985,254; 4,624,173; 4,846,911; 5,076,135; 5,125,179; 5,285,763; 5,454,289 and 6,725,759; and British Patent Application No. 2,187,826A are examples of such guns which are made with barrels of different constructions.

A typical rail gun includes an elongated barrel which has a pair of longitudinally extending, parallel conductors or rails disposed symmetrically about its axis. The rails are separated by a pair of elongated insulating members and are connected at their rearward or breech ends to opposite terminals of a source of direct current. A circuit through the rails may be completed either by a conductor disposed between the rails or by a plasma arc between the rails and results in the flow of current which generates magnetic flux between the rails. The flux cooperates with the current in the conductor or the plasma to accelerate the conductor or plasma along between the rails. The projectile may include the conductor or may be positioned forward of the conductor or plasma arc and is driven forward thereby.

In addition to accelerating the projectile forward, electromagnetic forces generated during firing of the rail gun will include repulsion forces which tend to push the rails apart, i.e. outward. When a plasma arc is employed, additional bursting forces may result from gas pressure generated within the barrel which will act more symmetrically upon the entire bore structure. These radially outward forces are comparable, or greater in magnitude, to those experienced in barrels of conventional chemical explosive guns. Moreover, when a rail gun is fired, the rails conduct very high electrical current and are thus heated to high temperatures while being subjected to these bursting forces, so it may be desirable that the rails be cooled during firing.

In a rail gun, it is desirable that the two rails and the adjacent insulating members fit together with very close tolerances and be tightly constrained against displacement radially outward. It may also be desirable that the barrel be relatively light so that it may be moved rapidly for aiming, particularly if such is designed for shipboard use where it may be necessary to stabilize location for firing in a heavy sea. Relative lightness is also advantageous in minimizing the amount of droop or sag in an elongated, cantilevered structure such as a barrel for an artillery piece.

Rail gun barrel assemblies have employed various compression devices about the barrel components to resist these bursting forces. The '173 patent teaches the use of a pair of generally pie-shaped rails (in cross-section) that are spaced apart by a pair of generally pie-shaped insulators located within a rigid outer shell of circular cross-section. A pressure medium is employed to fill the annular part of the barrel between the interior surface of the shell and the exterior surface of the rail-insulator composite structure and supply a preload thereto. Examples of pressure media disclosed were water, oil, a resin that would harden in situ and continue to apply compressive stress, and an elastomeric material that would fill the annular region and then be pressurized, as by inward movement of screw pistons or the like.

The '135 patent describes certain more sophisticated ways of using a fluid-filled bladder to pressurize the region of a rail gun barrel surrounding a bore-defining composite structure located interior of a rigid, oval containment tube. The '289 patent injects an epoxy resin or the like under a pressure of 2000-4000 psi into such an annular surrounding region which is hardened to apply a compressively preload to the composite rail-insulator structure that defines the bore. The British application shows preloading a pair of rails within a tubular steel shell through the supply of hydraulic fluid to a pair of rubber bladders in elongated chambers of rectangular cross-section that are disposed immediately radially outward of the spaced-apart rails.

The '911 patent discloses compressive preloading of a rail-insulator composite structure that defines the bore by employing an oval shape, filament-wound shell and a pair of spacers of rigid ceramic material. The spacers separate the rails from the interior surface of the two ends of the oval tube. A hydraulic jacking mechanism is inserted into the bore of the rail gun between the two rails, and force is applied to spread the rails apart (radially of the bore) and in this manner place the exterior filament-wound tube in tensile stress so as to preload the shell. While in this condition, a pair of rigid ceramic insulators is slidably inserted into the barrel to occupy the entire space between the two sets of rails and spacers except for the bore. When the jacking arrangement is withdrawn, the pretensioned filament-wound shell applies compression to the composite rail-insulator structure and preloads it.

The '179 patent teaches the manufacture of a gun barrel with a precompressed ceramic liner created by a tensioned overwrap in the form of an outer composite sleeve of braided tows of high tensile stress graphite fibers in a matrix of a thermosetting polyimide resin. An apparatus is shown for tensioning the graphite fiber braid while the structure is baked in an oven to cure the epoxy or polyimide resin that saturates the braided graphite fiber structure, providing the pretensioned shell for the gun barrel.

Although all of the above-mentioned concepts have focused upon the need to provide an arrangement for prestressing the bore components in order to place them in a state of compression which is higher in magnitude than the stresses that will be induced by the electromagnetic and/or plasma forces which will tend to move them radially outward, unfortunately, it is felt that none of these solutions has provided a truly lightweight structure wherein bore components are maintained in a constant state of hoop compression even while the interior is experiencing high internal forces, which may include repulsion forces that are tending to separate the two rails. Such forces may often exceed 10 MegaNewtons per meter of rail, which may be in addition to bursting pressure resulting from a plasma armature. As a result, the search has gone on for improved rail gun barrel assemblies.

SUMMARY OF THE INVENTION

It has now been found that a gun barrel having a bore through which a projectile may be accelerated, that is truly lightweight, can be constructed through use of a combination of two mechanically different preloading mechanisms. The combination utilizes (a) an integral inner shell that is pretensioned and produces substantial hoop stress in an interior direction on a tubular structure disposed internally thereof, which may be a generally annular, composite structure comprising spaced apart rails and insulators that define an axial bore of the gun barrel, and (b) a pressure medium arrangement disposed between this shell and an outer rigid tube. It has been found that the further compressive preload that is applied by such pressure medium in this combination will be additive to that already being applied to the composite rail-insulator structure by the pretensioned shell. The result is a surprisingly greater total preload, whereas it had always been thought that the application of such a further compressive stress to the exterior surface of a pretensioned tubular shell, particularly one where such preloading is provided by multiple wrappings of fiber tows under substantial tension, would simply negate the effect of the interior pretensioning wrappings and the result would be substantially no more effective than would be either one alone. However, it has now been surprisingly found that the use of these two different preloading mechanisms in combination need not be antagonistic. It has now been shown that the two mechanisms can produce a result that is truly effectively additive and will create an overall preload of greater magnitude upon an interior tubular structure, such as a central, composite, rail-insulator structure; in other words, the combination can provide a gun barrel that is lighter in weight and of lesser size, e.g. diameter, than if either mechanism were to be used alone to make a comparable gun barrel. The improvement is considered to be advantageous for use in gun barrels for rail guns and conventional weapons, particularly in instances where the pressure medium will contribute at least about 5 ksi to provide an overall prestressing of at least about 25 ksi. A further advantage of such a structure is that because a barrel can tolerate higher internal pressures, it can be made shorter and still be effective to deliver a desired amount of energy to a projectile. Moreover, although the tubular structure may be constructed to have a circumferentially uniform prestress, for certain rail guns, e.g. those where creation of a plasma is minimized or even totally avoided, it may be even more advantageous to employ a circumferentially varied prestress in a rail gun barrel.

In one particular aspect, the invention provides a rail gun barrel having a bore through which a projectile may be accelerated, which barrel comprises an outer rigid tube; a pair of spaced apart rails disposed within said tube; a pair of spaced apart insulators which separate said rails in a central region within said outer tube, said rails and said insulators being elongated and having side faces that are juxtaposed with one another to form a generally annular composite structure having a defined interior bore; a prestressed shell which applies compressive stress to said composite bore-defining structure; and a pressure medium positioned between said shell and the interior surface of said tube, which pressure medium is operative to apply compressive stress to said shell at least at locations generally radially outward of said rails, whereby compressive stresses applied by the combination of said prestressed shell and said pressure medium are additive and effective to preload the rails to adequately resist bursting forces that include an electromagnetic repulsion forces and axisymmetric pressure when a plasma armature is employed.

In another particular aspect, the invention provides a method of providing a lightweight rail gun barrel having a bore through which a projectile may be accelerated, which method comprises providing a pair of elongated rails and a pair of elongated insulators, which rails are spaced apart by said elongated insulators and together constitute a composite structure that defines the bore; radially surrounding said composite structure with a shell that prestresses said composite structure, providing an outer rigid tube; and positioning a pressure medium in an intermediate region between said prestressed shell and the interior surface of said outer tube and causing said pressure medium to apply compressive stress to said shell, whereby compressive stresses applied by said prestressed shell and by said pressure medium to said composite structure are additive.

In a further particular aspect, the invention provides a gun barrel having a bore through which a projectile may be accelerated, which barrel comprises an outer rigid tube; an interior rigid structure having a defined interior bore; an elongated integral tubular shell immediately surrounding said interior rigid structure, which shell applies compressive stress to said interior structure; and a pressure medium positioned between said tubular shell and the interior surface of said outer rigid tube, which pressure medium is operative to apply compressive stress to said shell at least at locations generally radially outward of said rails, whereby compressive stresses applied by the combination of said prestressed shell and said pressure medium are additive and provide compressive stress to adequately resist bursting force of 25,000 psi or greater in a gun barrel of lesser cross sectional dimension than can be attained by separately using either a prestressing integral shell or a pressure medium that exerts force in all directions.

DETAILED DESCRIPTION OF THE PREFERRED EMBODIMENTS

Figure 1:
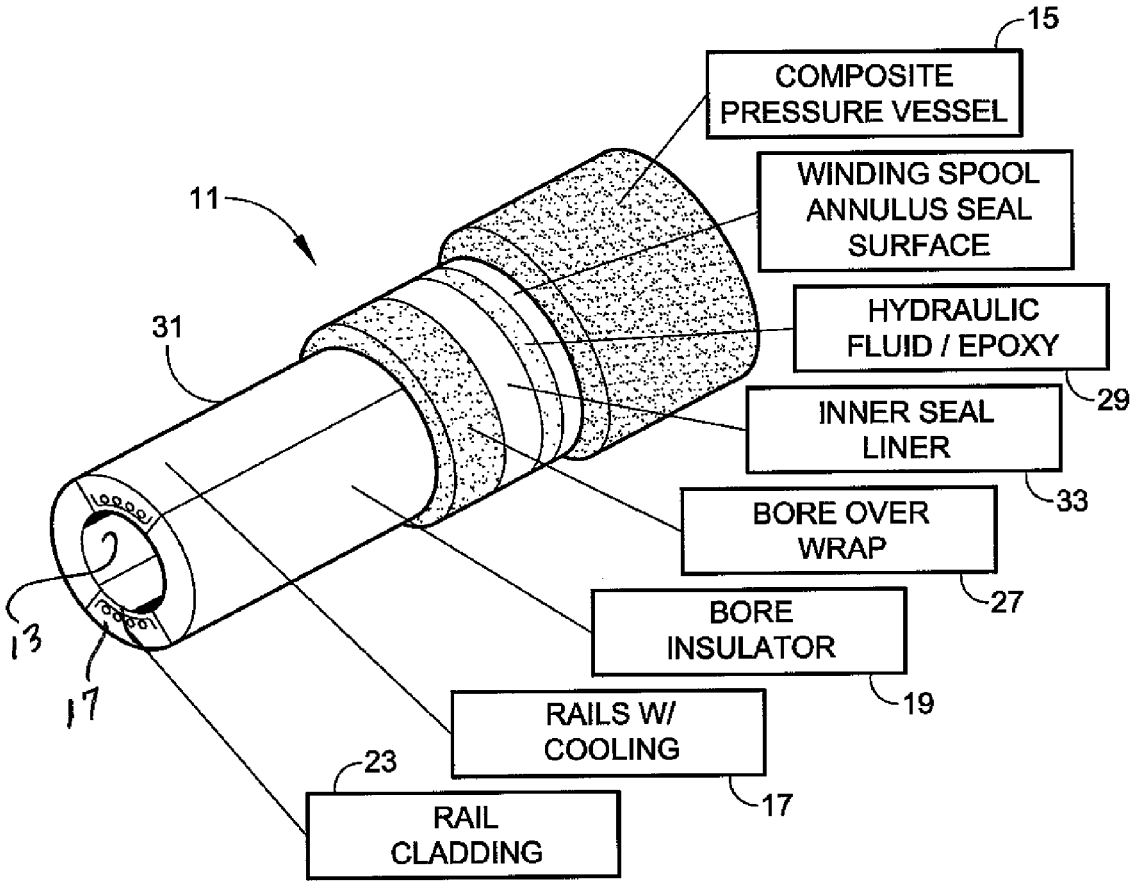
FIG. 1 is a schematic perspective view of a rail gun barrel embodying various features of the invention, wherein the individual components are sequentially cut away to better illustrate their arrangement and construction.
Figure 2:
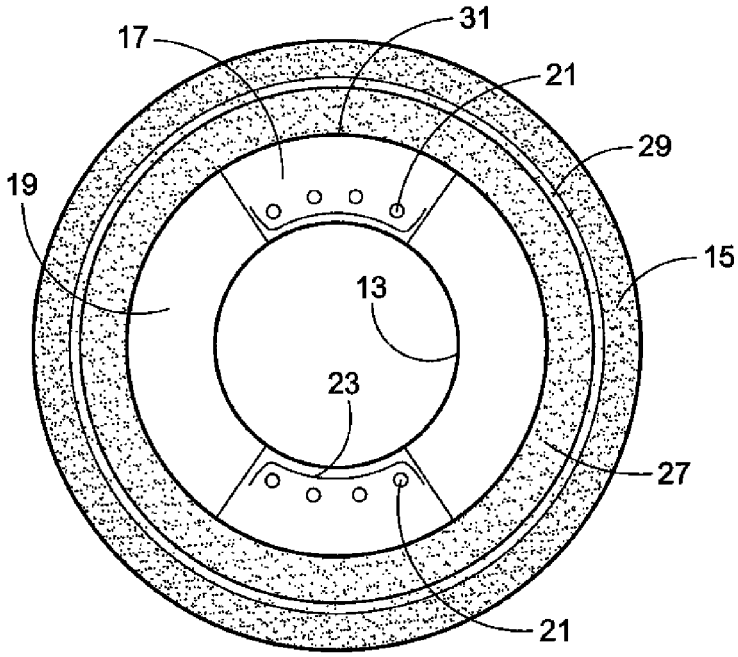
FIG. 2 is a cross-sectional view, enlarged in size, of the rail gun barrel of FIG. 1 taken generally along the line 2-2 of FIG. 1.

One preferred embodiment of an improved tubular structure incorporating various features of the present invention is illustrated as a rail gun barrel 11 in FIGS. 1 and 2 which includes an elongated bore 13 for passage of a projectile. The rail gun barrel 11 comprises a rigid outer tube or pressure vessel 15, a pair of elongated, generally parallel conductive rails 17 and a pair of elongated, generally parallel insulators 19 that are disposed circumferentially between and interfit with the rails 17 to create a composite tubular structure which defines the bore 13.

The two rails 17 are disposed symmetrically about the longitudinal axis of the barrel, as are the two insulators 19. The rails 17 may be made of a copper alloy or other conducting material and are electrically connected at their respective rearward or breech ends to opposite terminals of a source of direct current (not shown) as well known in this art. The rails have longitudinal passages 21 formed in them for coolant flow, as also well known in the art.

The rails 17 and insulators 19 have juxtaposed, mating side faces that fit together to create a composite structure that defines a generally cylindrical central bore 13 through which a projectile will travel. The bore 13 will often be of circular cross section as shown; however, it may alternatively be of rectangular or other suitable cross section as illustrated and described hereinafter. Generally the shape that is selected will be application-dependent. The composite structure of rails and insulators that defines the bore 13 is annular in FIGS. 1 and 2; however, because this structure may also have an elliptical, oval or other such shape, the term "generally annular" is used herein to mean any such cross-sectional shape. If desired, the radially inner surfaces of the rails can be provided with a strong, hard, wear-resistant cladding 23, such as one made of a refractory metal, e.g. molybdenum or tantalum or an alloy thereof.

When one is ready to fire a projectile that has been loaded into the breech, a circuit is completed through the rails either by a solid conductor or armature or by a plasma arc disposed between the rails 17. Where a plasma arc is used, particularly high bursting fluid pressures may be generated within the barrel by vaporization of a strip metal. As current flows through the circuit, magnetic flux is generated between the rails 17, which flux cooperates with the current in the armature or plasma arc to accelerate the projectile forward along the rails 17. The projectile may include the armature, or it may be positioned forward of the armature or plasma arc and be driven forward thereby. It is desirable that the rails 17 and insulating members 19 be constrained against radially outward movement because, when the rail gun is fired, electromagnetic Lorenz repulsion forces resulting from the interaction of the current with the flux tend to push the rails 17 apart. A plasma armature or a plasma arc may also create high, axisymmetric pressure loads that are exerted locally behind a traveling projectile, typically over a distance of about 10 bore diameters, which bursting forces within the bore 13 add to such repulsion forces pushing the rails 17 apart. Repulsion forces in a rail gun may tend to separate the rails at magnitudes of about 15 MegaNewtons or more per meter of rail in the region of the armature. They may often exert forces of about 25 MegaNewtons or more, and in large weapons, such forces may exceed 50 MegaNewtons per meter. In addition, there may be axisymmetric plasma-generated bursting forces that will be additive. In the past, it has been recognized that preloading the rails 17 and insulating members 19 with radially inward directed forces, i.e., preloading the rails prior to firing, is needed to constrain them, and the present invention improves upon such past attempts to preload the rails.

The illustrated embodiment of the rail gun barrel 11 is relatively lightweight, relative to prior art attempts to achieve comparable preloads, because the rails 17 and insulators 19, which together form an annular composite structure defining the bore 17, are constrained against radially outward displacement by a very effective preloading arrangement. A prestressed shell 27 immediately peripherally surrounds the annular composite bore structure, being in contact with its exterior surface, and the lightweight outer rigid tube 15 is coaxially disposed in surrounding relationship thereto. A pressure medium or sleeve 29 is located in the annular region between the shell 27 and the interior surface of the outer rigid tube 15, and in this arrangement, it applies approximately uniform isostatic pressure throughout its region, exerting radial compressive forces upon the radially outer surfaces 31 of the rails 17 and also upon the insulating members 19, and consequent radially outward forces against the interior surface of the rigid outer tube 15. If desired, a thin, inner seal liner 33 can be used as a wrap about the prestressed shell 27 and a similar seal may be included between the hydraulic medium and the outer rigid tube 15. The pressure medium 29 is pressurized prior to firing of the rail gun. The pressure medium 29 may be a bladder or the like which contains a hydraulic liquid, or it may be a suitable elastomer, as known in this art. In the illustrated embodiment, the pressure medium is a resin that has been injected into the annular region under high pressure and subsequently cured in such state, as taught in the '289 patent.

Resin-impregnated strands of glass filaments, aramid fibers, carbon fibers, boron fibers, PBO fibers or other such high-performance fibers have long been wound about mandrels which are then removed to construct pressure vessels and other such tubular structures. Glass filaments are often used, and high modulus fibers are often preferred for pressure vessels. However, for the present application, filaments that have a low modulus, e.g., in the general range of about 2 Msi to about 10 Msi, are preferred for such a large number of overwraps. Glass filaments which have a modulus of 5 Msi or less are preferred. Modulus is the mathematical value that describes the stiffness of a material by measuring its deflection or change in length under loading. Other fibers that have a higher tensile strength will often have a higher modulus and be less desirable for such reason. In the present situation, fibers that have high tensile strength and low modulus are preferred; however, very high tensile strength, which will allow winding with greater force, will offset higher modulus to some degree. Filaments are herein wound with a tension that is greater than generally used in conventional applications; they are preferably wound using a tension as high as reasonably feasible without breaking or damaging the fibers. There are many factors that are taken into consideration in determining the winding tension used, including the design of the winding equipment and the character of the fiber being wound. Winding glass fibers will usually use at least about 10 pounds and may often be greater than about 20 pounds, and sometimes even greater than about 65 pounds.

High tensile strength glass filaments are often selected, and they are preferably prestressed by being wound at a value of close to about 90% of their breaking strength. Although some E-glass fibers might be used, S-glass fibers which were developed for the aerospace industry and the military are preferred. The breaking tensile strength of E-glass can vary between 350-450 ksi, and S-glass can vary between 400-600 ksi. For example, those which are marketed as S-2 glass filaments, which have a relatively high yield strength, are preferred, particularly because they have a low modulus, preferably not greater than about 5 Msi. Stress is a function of force divided by fiber area, hence larger fiber tows can withstand much higher forces even though they break at the same stress. These low modulus fibers can be wound under reasonably high tension and thus may have economic advantages over other fibers that might be used. The filaments are preferably saturated with a suitable resin. Such can be a thermoplastic resin, such as a polyether etherketone (PEEK) resin; however, one of the conventional thermosetting resins well known in this art is generally used, such as an epoxy resin, a polyurethane resin, a polyester resin, an alkyd resin, a urea-formaldehyde resin, a melamine-formaldehyde resin or the like. Alternatively, the structure may be wound using dry fibers (no resin) and subsequently saturating the outer surface of the fibers with resin for protection.

Epoxy resins are readily commercially available and are preferred. The resin can be applied to the filaments in any suitable manner to saturate them with the resin, such as by spraying, dipping, brushing, doctoring or the like, and the resin can be in the liquid uncured state or in a partially cured state when the strands of filaments are being wound to form the pretensioning shell. The resin may be cured as winding takes place, as by using ultraviolet curing or the like as known in this art or room temperature catalyst-induced curing which is feasible for certain resins, and is commonly finally oven-cured following winding of one or more layers about the interior structure. For example, U.S. Pat. No. 6,074,595 and patents referenced therein disclose such curing steps which are well known in this art.

Apparatus for winding-resin impregnated filaments to create shells is commercially available and has been for many decades; see for example U.S. Pat. No. 3,112,234. Use of such an apparatus to create lightweight pressure vessels is also well known, as taught in U.S. Pat. Nos. 3,969,812; 6,190,481; and 6,401,963. Such apparatus typically uses rotation of a mandrel or other generally cylindrical structure about its longitudinal axis, around which mandrel the shell is being created. Resin-impregnated filaments are pulled and wound around the rotating, generally cylindrical surface, being fed from a translating carriage using a system which maintains the desired pounds of tension on the filaments, as taught in these patents. To provide the desired hoop stress pretensioning in the resultant interior shell 27, the filaments are wound at a wind angle of at least 45% to the horizontal, i.e. the horizontal axis of the rotating structure, and are preferably wound at a fairly steep angle. It may be desirable that this wind-angle preferably be at least about 60°, more preferably at least about 70°, and most preferably at least about 80°. At a wind-angle of about 80°, each pass from one end to the other along the composite bore defining structure obtains substantially complete coverage and is considered to constitute one layer. It is recognized that the wind-angle used may be varied throughout the winding; however, the aforementioned wind-angles would be used at least about 50% of the time so that at least a major portion of the axial length of the mandrel is so wrapped.

The force that fibers or filaments can withstand is dependent on the size of the tow, the number of fibers, the diameters and finish on the idler wheels in the winding installation, etc. The fibers are pulled with a force such that they are at least about 80% of the breaking point and preferably at between about 85% to 90% thereof. Smaller diameter tows see less cyclic loading across idler wheels, so there is a mixed range of forces of concern. Generally, S-fibers can be wound with forces that range anywhere from 25-175 pounds.

Many multiple layers have heretofore been used to obtain high compressive prestress, such as that needed in a rail gun barrel; however, as the number of layers increases, each additional layer begins to contribute less and less because each new layer tends to relieve some of the stress that was added by the previous layers, while also undesirably increasing the weight of the structure. Although the ability to wind low modulus fibers at higher tensions can increase the amount of prestress that can be achieved at relatively low weight, such fibers and/or winding techniques have not been available to effectively resist bursting stress of greater than about 25,000 psi and/or repulsion force of 15 MegaNewtons or more per meter of rail at the time of firing. By maintaining tension on the S-glass filaments throughout the winding of the multiple layers, a substantial hoop stress is produced on the bore-defining composite structure of rails and insulators. The composite bulk elastic modulus of this filament-wound shell 27, as a result of the modulus of the particular fibers used and the character of the hardened resin, allows such a shell to be fabricated using such pretensioned filaments which has a hoop modulus of not greater than 10 Msi, and preferably not greater than about 5 Msi. Such a shell, when thereafter subjected to radially inward compressive stress from a radially exterior pressure medium has surprisingly been found to still very substantially contribute to the overall inward compressive stress upon the bore-defining tubular structure.

The outer rigid tube or pressure vessel 15 may be made of any suitable material, but, where weight is of concern, it is preferably made of a non-metallic material. Examples of suitable vessels include glass fiber or carbon fiber wound vessels as known in this art and described in the afore-mentioned U.S. patents that are made without substantial pretensioning, as well as vessels made with woven graphite or carbon or silicon carbide fibrous material as a reinforcement within a hardened polymeric resin that may be any of the types of resins mentioned hereinbefore.

In this illustrated embodiment, the pressure medium 29, which creates forces radiating in all directions, is a polymeric resin that was injected into the annular region under high pressure and then cured to solid state while still under that pressure. When resin is to be directly injected into the annular region between the coaxially disposed composite bore structure/shell 27 and the outer tube 15, it may be desirable to provide a thin overwrap 33 as a seal liner about the shell 27. This liner 33 can be made of any suitable material, such as thermoplastic or rubber sheet material or metal foil. Alternatively, a thin expandable bladder can be first disposed in this annular region and the hardenable resin then injected under high pressure into the bladder which will itself serve as a liner. In any event, after the annular region has been suitably confined or sealed, a suitable pressure injector is used to inject a hardenable polymeric resin into the space, and this pressure on the resin is maintained until the resin has cured to solid form. To achieve the desired total compressive prestress, resin is injected using at least 5,000 psi, is preferably injected at least about 10,000 psi, and more preferably at between about 15,000 and about 30,000 psi. Once the resin has hardened under pressure and cured, the barrel is complete, and the composite bore-defining structure is very effectively prestressed. As a result, there is no longer any need to maintain pressure or maintain seals, which is advantageous compared to the alternative of using hydraulic fluid in a bladder; moreover, the resultant solid, annular structure contributes to the retention of bore straightness. Of course, when a non-hardenable hydraulic fluid is instead used in a bladder as a pressure medium, the pressure can be dynamically controlled over time which may be of advantage.

This concept is tested by constructing a prototype having a pair of rails 17 and insulators 19 similar to that shown in the cross-sectional view of FIG. 2. The interior cylindrical bore has an inner diameter of 155 mm, and the outer diameter of the composite structure about which winding of the shell takes place is about 250 mm. High tensile strength S-glass filament saturated with a commercial thermosetting epoxy resin, such as a rapid-cure epoxy resin sold by MAS Epoxies of Cinnaminson, N.J., or one sold by U.S. Composites, Inc. (West Palm Beach, Fla.) as 635 Epoxy Resins, or one sold as EPON Resin 826, by Resolution Performance Products of Houston, Tex., is wound about the cylindrical structure while such is being rotated, using a wind-angle of about 80° and a tension of 20 pounds on the filament. Winding is carried out to apply increments of 100 layers of filament windings exterior of the structure with a resin that initially cures in about 5 minutes at room temperature while the filaments remain under tension in order to lock in the prestress as soon as possible. Subsequent final curing of the resin may be effected by baking for about 4 hours at 180° C. Testing is then carried out to show what internal bore pressure such prestressed shells made with 100, 200, 300, etc. windings will withstand, and the results are plotted. These calculations show that it would require approximately 1,092 layers to provide sufficient prestressing to withstand a target bore pressure of about 60,000 psi (60 ksi), for example.

Next, such a prestressed shell structure is positioned coaxially in a rigid outer tube 15 having an inner diameter about 2-10 mm larger than the OD of the particular shell and composite bore structure, and the annular space is filled with a pressure medium that is pressurized to about 25 ksi, and hardened while under this pressure. The amount of internal bore pressure that such structures having various layers of fiber windings in the shell 27 will withstand is again measured. The results show that it will require only about 128 layers of filament wrappings in the prestressed shell 27, when arranged in combination with a pressure medium which exerts 25 ksi of compressive stress, to withstand a target internal bore pressure of 60 ksi. Such pressure is considered to be generally equivalent to the outward force that might be placed upon a pair of rails during firing of a projectile that subjects the rails to a repulsion force of about 40 MegaNewtons per meter.

As a result of such tests, it can be shown that a rail gun barrel for a 155 mm bore gun that would withstand a target bore pressure of about 60 ksi can be constructed using a prestressed-filament wound shell 27 only about 44 mm thick in combination with a surrounding annular pressure medium that exerts 25 ksi and that might only occupy a space about 20 mm thick plus the outer shell which might have a thickness of about 55 mm, for a total wall thickness of about 119 mm exterior of the surfaces of rails that are about 5 cm thick. The outer diameter of such a barrel would be about 40 cm. In contrast, the need to provide nearly 1100 layers using a filament-pretensioned shell alone to withstand like internal bore pressure would result in a shell that would have a thickness of about 42 cm, and the gun barrel would have an outer diameter of about 110 cm if the rails were again about 5 cm thick. Alternatively, if a similar pressure medium alone were used, the outer diameter of the gun barrel for a 155 mm bore might be about 51 cm. This comparison shows the advantageous and surprising result of this combination of prestressing mechanisms in such an environment.

Figure 3:
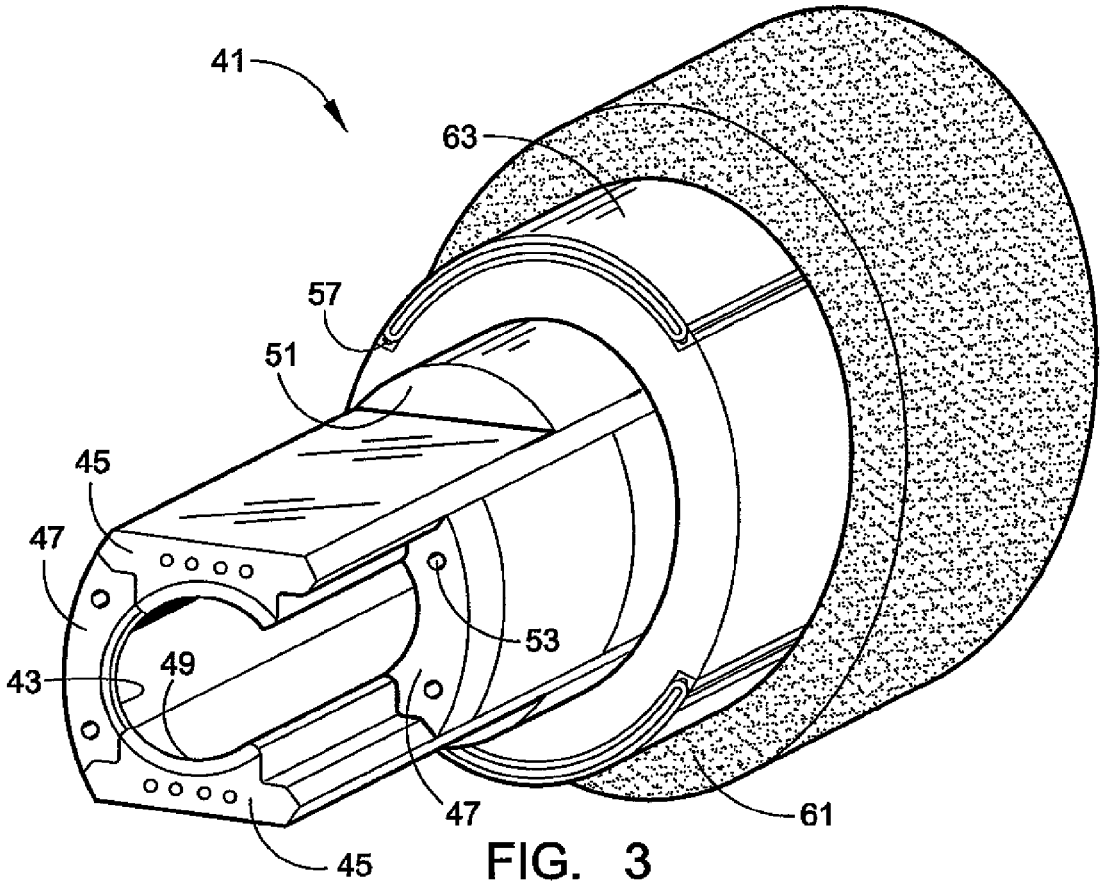
FIG. 3 is a schematic perspective view of an alternative embodiment of a rail gun barrel embodying various features of the invention, wherein the individual components are sequentially cut away to better illustrate their arrangement and construction.
Figure 4:
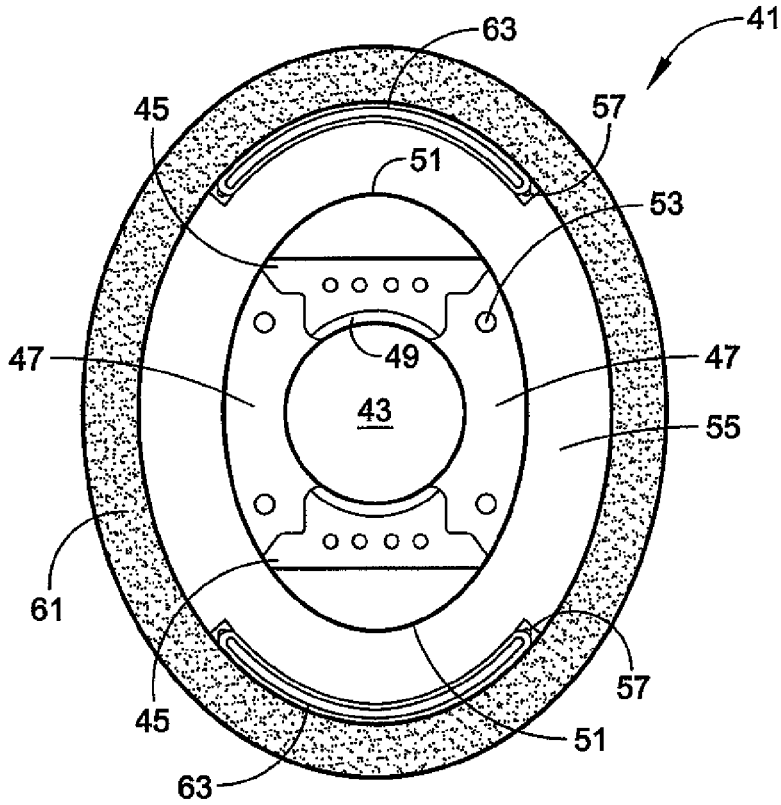
FIG. 4 is a cross-sectional view, enlarged in size, of the rail gun barrel of FIG. 3.

An alternative construction embodying various features of the invention that may be particularly preferred for a rail gun barrel is shown in FIGS. 3 and 4 where the barrel 41 is constructed to have an elliptical cross-section although the bore 43 remains circular. A central circular cross-section bore 43 is again defined by a pair of elongated, generally parallel, conductive rails 45 and a pair of elongated, generally parallel, insulators 47 that are disposed circumferentially between the rails, interfitting with them and spacing them apart to complete the central internal bore. The side faces of the elongated rails 45 and insulators 47 are designed to mate with one another so as to provide an overall, interlocking composite bore structure. The radially outer surfaces of the rails 45 are flat, and the radially inner surfaces are shaped to provide radially inward recesses where cladding 49 can be fixed to the surfaces as described hereinbefore. The radially outer surfaces of the insulators 47 have an arcuate cross-section which is a segment of an ellipse, and to complete the elliptical cross sectional shape of the composite, generally annular, bore-defining structure, a pair of spacers 51 made of a suitable rigid material, such as a fiber-resin composite or alumina, are provided which are juxtaposed with the flat, back surfaces of the rails 45. As earlier described, the rails 45 may have longitudinal passages formed in them for coolant flow as known in this art. Depending upon the strength of the insulator material, which may be alumina or a similar ceramic, it may be desirable to include longitudinal pretensioning rods 53 as a part of the elongated insulators 47.

A pretensioned shell 55 is again filament-wound around the composite, elliptical cross section structure that defines the rail gun bore 43. This pretensioned shell 55 is constructed as previously described using S-2 fibers having low modulus and high tensile strength that are wound with a tension equal to about 90% of their breaking point. The thickness of the pretensioned shell 55, that is built up by again using many multiple layers, because of its elliptical shape, provides more inward compressive force upon the rails 45 (where it is needed) than it does upon the insulators 47 which are formed with outer surfaces of shallow curvature. The shell is wound about the composite bore structure using a wind-angle of between about 75° and about 85°. Based upon the experimental data previously determined, about 125 to about 150 layers are used to create the pretensioned shell 55. This would, in and of itself, be sufficient to exert an inward compressive pressure sufficient to withstand about 30 ksi interior of the composite bore-defining structure.

In the illustrated embodiment, after the desired thickness for the pretensioned shell 55 has been achieved, winding is continued to overwrap the shell for about another 30-40 percent of thickness of this shell. This provides an integral structure exterior of the thickness of the basic shell 55 into which a pair of curved or arcuate recesses 57 can then be cut following the curing of the overwrapped shell. The recesses 57 are located on the long axis of the ellipse, generally radially outward of each of the opposed rails 45, and they provide two arcuate chambers located along segments of the ellipse of smallest radius of curvature in which a pressure medium will be located. These recesses 57 are conveniently machined into such structure after the resin has finally cured. Such machining essentially eliminates the outermost overwrapped windings of the shell from contributing to the desired compressive stress upon the composite bore-defining structure, so it is the thickness of the shell 55 interior of these two arcuate regions 57 that is relied upon to provide at least the desired minimum compressive stress contribution. Rather than overwinding the elliptical cross-section shell 55 to such a greater thickness, a pair of arcuate spacers could alternatively be adhesively fixed to the exterior of the shell 55 in the two lateral regions radially outward of the insulators 47; such spacers would be proportioned to provide gaps or recesses therebetween which will constitute the pressure medium chambers 57.

This entire arrangement is disposed within an exterior rigid tube 61. Such outer tube 61 can be prefabricated, if desired, and as such, it may be a filament-wound structure having the construction previously described with regard to the tube 15 to minimize weight. Although the outer rigid tube 15 may be prefabricated, there are manufacturing advantages to being able to fabricate the tube 61 in situ, exterior of the pretensioned bore subassembly. It may be expedient to construct the tube in situ on the same mandrel by overwinding the subassembly after a pair of bladders 63 are disposed in the recesses 57; alternatively, suitable provision might be made with spacers to preserve the elliptical configuration in the regions of these arcuate chambers 57 before further winding. The bladders 63 would be thereafter inserted, or the recesses 57 would be filled with a pressure medium similar to medium 29 in FIG. 2. Using either alternative, the arrangement depicted in FIG. 4 is obtained wherein the arcuate recesses 57 are located on the long axis of the cross-sectional ellipse where they are disposed generally radially outward of only the rails 45 and occupy the regions of the smallest radii of curvature.

In the illustrated embodiment, there are shown a pair of thin bladders 63 disposed respectively in the two arcuate recesses 57 which are used to provide the pressure medium. Such bladders 63 can be used in either of two ways. As taught for example in U.S. Pat. No. 4,624,173, the bladders can be pressurized to exert, for example, 25 ksi compressive stress upon the rails by being fluid-pressurized, for example hydraulically, prior to firing the rail gun. Alternatively, the bladders 63 may simply be used to conveniently confine a polymeric thermosetting or other resin that is injected into the two bladders at, for example, 30,000 psi; when hardened under this pressure, the two segmental regions will together exert about 25 ksi compressive stress in the general region of the rails. As a result of this combination, a total compressive stress of about 60 ksi is exerted in the general regions of the pair of opposed rails, preloading them radially inward. Although the pressure medium in the bladders 63 will not have as great an effect upon the insulators 47 as a result of this circumferentially variable compressive stress arrangement, the amount of pretensioning provided by the shell 55 in the regions of the insulators 47 is adequate to maintain the integrity of the bore. As previously mentioned, in a rail gun barrel, the primary outward forces are those electromagnetic Lorenz repulsion forces that act upon the metal rails 45 and create an asymmetric pressure load, whereas the ceramic insulators 47 are primarily acted upon by the bursting forces from the gas within the bore. This embodiment effectively focuses the pretensioning compressive stress where it is most needed in a rail gun, and the result is a rail gun barrel 41 of a cross sectional size smaller than one could achieve using only a filament-wound prestressed polymeric shell or a pressure medium alone, as does the embodiment shown in FIGS. 1 and 2.

Figure 5:
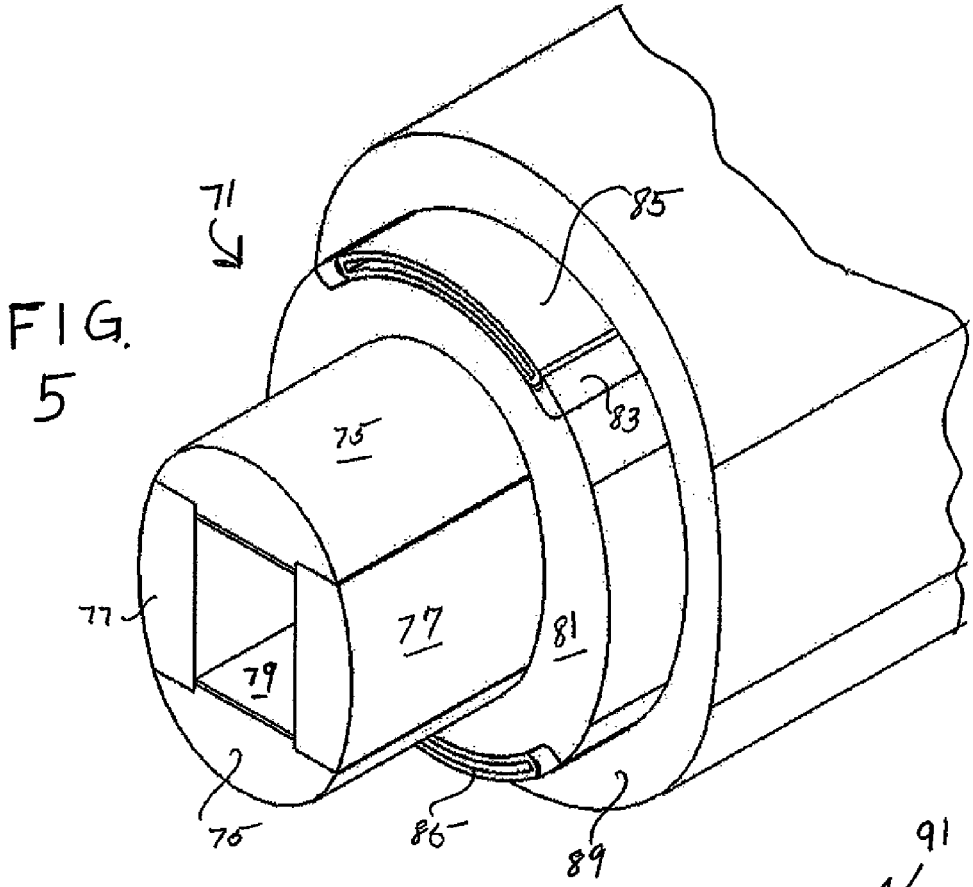
FIG. 5 is a schematic perspective view of another alternative embodiment of a rail gun barrel embodying various features of the invention, generally similar to FIG. 3.
Figure 6:
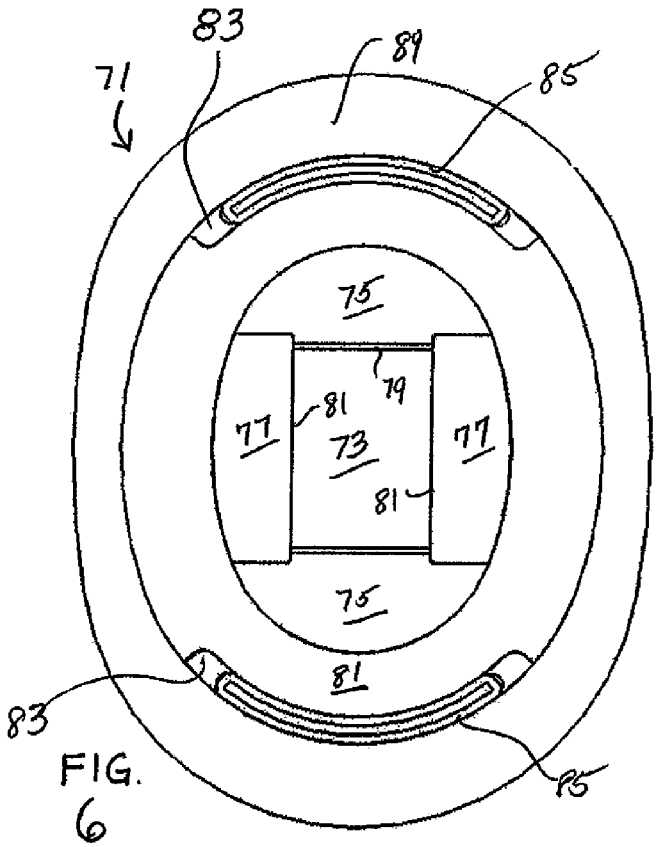
FIG. 6 is a cross-sectional view of the rail gun barrel of FIG. 5.

Illustrated in FIGS. 5 and 6 is another alternative embodiment of a rail gun barrel 71 which closely resembles the rail gun barrel 41 just described. Again, the composite tubular structure is designed to have an elliptical exterior cross-section; however, this time the bore 73 is rectangular and thus is designed to fire a projectile of rectangular cross-section, or to fire a projectile of any shape contained therein which is driven by an armature with flat contact surfaces. The bore 73 is again defined by a pair of elongated, generally parallel conductive rails 75 and a pair of elongated, generally parallel insulators 47. The rails are spaced apart from each other and, in turn, space the rails 75 from each other. In the illustrated arrangement, the interior faces of the rails 75 are again shaped to interfit with the insulators, and the interior rail surfaces, which are flat and constitute the two narrower sides of the rectangular bore 73, are again provided with wear-resistant cladding 79. The two longer walls of the rectangular bore 73 are provided by the interior surfaces of the insulators 77. The materials used in construction may be the same as described with regard to the rail gun barrel 41.

A pretensioned shell 81 is then filament-wound around the composite, elliptical cross-section structure in the same manner as previously described. After the desired number of layers have been wound to effect the desired pretensioning, winding is again continued to overwrap the shell 81 for desired additional wall thickness to accommodate a pair of recesses 83, as previously described with respect to the rail gun barrel 41. After the overwrapped, pretensioned shell structure 81 has been cured, the recesses 83 are cut into the exterior surface at the two end regions of the smallest radii of curvature to provide arcuate regions of desired thickness for the pressure medium.

In the preferred fabrication method, a pair of thin bladders 85 are disposed respectively in the recesses 83, and winding is continued on the same mandrel about this subassembly, in the general manner as a rigid, filament-wound pressure vessel might be conventionally created, to create an outer, rigid tube 89. Once the ultimate structure has been cured, the bladders 85 in the rail gun barrel can be either pressurized once with a resin that would be then cured under such high pressure as described with regard to the FIGS. 1 and 2 embodiment, or the barrel can be simply left with the pair of bladders 85 to be hydraulically pressurized to a desired level prior to firing of the rail gun.

Figure 7:
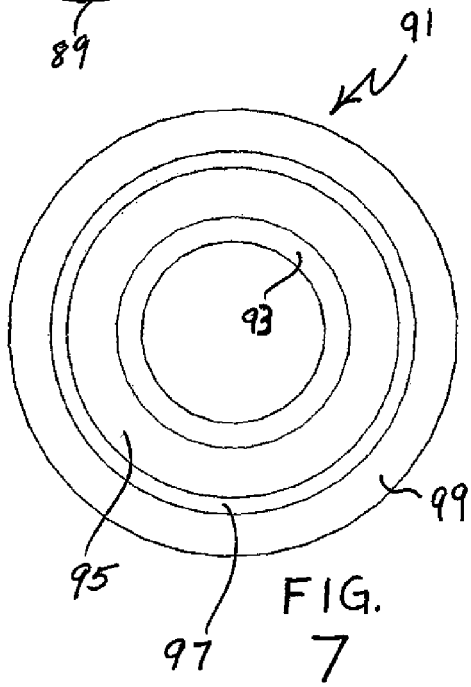
FIG. 7 is an end view of a further gun barrel embodiment.

Although the invention has been described with regard to certain preferred embodiments, which constitute the best mode presently known to the inventors, it should be understood that changes and modifications may be made to these illustrated embodiments as would be obvious to one having ordinary skill in this art, without departing from the scope of the invention which is defined in the claims appended hereto. For example, although only circular and rectangular rail gun bores and circular and elliptical cross-section outer rigid tubes are illustrated, it should be understood that other shapes, such as polygonal or oval for example, could be alternatively used. Moreover, although three rail gun barrels were described in detail, the invention may also be used for gun barrels for conventional artillery pieces. Such an artillery gun barrel 91 is shown in FIG. 7 where a metal bore tube 93 is surrounded and prestressed by an inner shell 95 such as that described as shell 27 and located within a rigid outer shell 99 of circular cross section. The region between the 2 shells is filled with a pressure medium 97 like the medium 29. Other tubular structures than gun barrels which need to endure high internal pressures, particularly structures having a length at least several times their diameter, might also benefit from such a construction. Likewise, although the employment of S-glass filaments and epoxy thermosetting resin is described and presently preferred, other suitable filaments, e.g. carbon filaments, and other polymeric materials, e.g. PEEK thermoplastic resins, that will also form a substantially rigid shell can be employed. In addition, as mentioned, the prestressing shell can be provided by dry-winding fiber tows and then saturating the tubular wound structure with a thermoplastic or thermosetting resin that is hardened while the impregnated fiber tows are maintained under tension. Furthermore, other prestressed integral tubular structures may alternatively be used interior of the pressure medium. For example, rigid metal tubing may be shrink fit or swaged or press-fit onto a generally annular, composite bore-defining structure so as to exert such prestressing interior thereof, as an alternative to winding a pretensioned filament-wound shell.

The disclosures of all U.S. patents mentioned herein are expressly incorporated herein by reference.

Particular features of the invention are emphasized in the claims that follow.

The invention claimed is:

1. A rail gun barrel having a bore through which a projectile may be accelerated, which barrel comprises:

an outer rigid tube;

a pair of spaced apart rails disposed within said tube;

a pair of spaced apart insulators which separate said rails in a central region within said outer tube, said rails and said insulators being elongated and having side faces that are juxtaposed with one another to form a generally annular composite structure having a defined interior bore;

a surrounding prestressed shell which is in contact with and applies compressive stress to said composite bore-defining structure, which shell is a filament-wound tubular structure wherein filaments having a high tensile strength and an elastic modulus of not greater than about 5 Msi are wound under tension about said composite bore-defining structure in predominately hoop orientation, with a hardened polymeric resin impregnated in said wound filaments; and a pressure medium positioned adjacent the exterior surface of said prestressed shell and within said outer rigid tube, which pressure medium is operative to apply compressive stress to the surface of said prestressed shell at least at locations generally radially outward of said rails, whereby the resultant compressive stresses applied by the combination of said prestressed shell and said pressure medium are additive and effective to preload the rails to adequately resist bursting forces that include electromagnetic repulsion forces and axisymmetric pressure if a plasma armature is employed.

2. The rail gun barrel of claim 1 wherein said pressure medium comprises a hardened polymeric resin that was injected and cured under high pressure.

3. The rail gun barrel of claim 1 wherein said pressure medium comprises an inflatable bladder into which a pressurizing fluid can be injected prior to firing a projectile.

4. The rail gun barrel of claim 1 wherein said pressure medium comprises a pair of inflatable bladders, one located radially outward of each said rail, and wherein means is provided to fill said bladders with hydraulic fluid at a pressure of at least about 5,000 psi.

5. The rail gun barrel of claim 1 wherein said outer rigid tube has a circular cross section.

6. The rail gun barrel of claim 1 wherein said prestressed shell and said outer rigid tube both have elliptical cross sections and said spaced apart rails are located on the long axis of the ellipse.

7. A method of providing a lightweight rail gun barrel having a bore through which a projectile may be accelerated, which method comprises:

providing a pair of elongated rails and a pair of elongated insulators, which rails are spaced apart by said elongated insulators and together constitute a composite structure that defines the bore;

radially surrounding said composite structure with a shell that prestresses said composite structure by winding filaments in predominantly hoop orientation about said composite structure under high tension up to about 85% to about 90% of their breaking point and hardening a polymeric resin which impregnates said wound filaments while said filaments remain under such tension to provide a prestressed surrounding shell which applies compressive stress upon the surface of said composite structure, providing an outer rigid tube; and positioning a pressure medium in an intermediate region between said prestressed surrounding shell and the interior surface of said outer rigid tube and causing said pressure medium to apply compressive stress to said shell, whereby compressive stresses applied by said prestressed shell and by said pressure medium to said composite structure are additive.

8. The method of claim 7 wherein said pressure medium applies at least about 5 ksi compressive stress to at least said rails, and wherein the total compressive stress applied to said rails by the combination of said prestressed shell and said pressure medium is more than 25 ksi.

9. The method of claim 7 wherein said compressive stress from said pressure medium is provided by injecting a polymeric resin under at least about 5,000 psi into said intermediate region and curing said resin to solidification while under such pressure.

10. The method of claim 7 wherein said pressure medium includes a pair of inflatable bladders, one of which is located radially outward of each said rail, and wherein said compressive stress to said shell is provided by inflating each bladder to at least about 20,000 psi.

11. The method of claim 7 wherein said shell is wound with filaments having a high tensile strength of at least about 400 ksi and an elastic modulus of not greater than about 10 Msi and wherein a wind-angle of about 70° or greater is employed for at least the major portion of the axial length of said shell.

12. The method of claim 7 wherein said filaments are glass filaments that have an elastic modulus of not greater than about 5 Msi and said cured shell has hoop modulus of not greater than about 5 Msi.

13. A rail gun barrel having a bore through which a projectile may be accelerated, which barrel comprises:

an outer rigid tube of generally elliptical cross section;

a pair of spaced apart rails disposed within said tube;

a pair of spaced apart insulators which separate said rails in a central region within said outer tube, said rails and said insulators being elongated and having side faces that are juxtaposed with one another to form a generally annular composite structure having a defined interior bore;

an elongated integral generally elliptical tubular prestressed shell immediately surrounding said interior rigid structure which applies compressive stress to the entire periphery of said composite interior structure; and a pressure medium positioned in two recesses between said tubular prestressed shell and the interior surface of said outer rigid tube on the long axis of said generally elliptical cross section, which pressure medium is operative to apply compressive stress to said shell at least at locations generally radially outward of said rails, whereby said compressive stresses applied by the combination of said prestressed shell and said pressure medium are additive and provide overall compressive stress to adequately resist bursting force of 25,000 psi or greater in a rail gun barrel having cross sectional dimensions less than those required to construct a barrel of such strength by separately using either an integral filament-wound prestressed shell or a pressure medium within a surrounding rigid tube.

14. The gun barrel of claim 13 wherein said pressure medium comprises a hardened polymeric resin that was injected and cured under at least about 5,000 psi.

15. The gun barrel of claim 13 wherein said pressure medium comprises a pair of inflatable bladders, one located radially outward of each said rail and centered on said long axis, and wherein means is provided to fill said bladders with fluid at a pressure of at least about 20,000 psi.

16. The gun barrel of claim 13 wherein said interior rigid structure has a bore of circular cross section.

* * * * *